US006299712B1

(12) United States Patent
Ibarra

(10) Patent No.: US 6,299,712 B1
(45) Date of Patent: Oct. 9, 2001

(54) APPARATUS AND METHOD FOR LABEL APPLICATION TO TRAYS FOR RECEIVING SEMICONDUCTOR CHIPS

(75) Inventor: Tony T. Ibarra, Nampa, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/411,532

(22) Filed: Oct. 1, 1999

(51) Int. Cl.[7] ..... B65C 1/00; B65C 1/02; B65C 9/00

(52) U.S. Cl. ..... 156/60; 156/349; 156/598; 156/DIG. 1; 156/DIG. 2; 156/DIG. 24

(58) Field of Search ..... 156/60, 349, 598, 156/DIG. 1, DIG. 2, DIG. 24, DIG. 27, DIG. 48

(56) References Cited

U.S. PATENT DOCUMENTS

| | | | |
|---|---|---|---|
| 4,369,582 | | 1/1983 | Pfeffer . |
| 4,436,573 | | 3/1984 | Sato et al. . |
| 4,585,505 | | 4/1986 | Matsuguchi . |
| 5,517,916 | | 5/1996 | Dour et al. . |
| 5,540,795 | | 7/1996 | Franklin et al. . |
| 5,851,332 | | 12/1998 | Kerr, Jr. . |
| 5,925,200 | * | 7/1999 | Grossman ..... 156/60 |
| 5,951,819 | * | 9/1999 | Hummell et al. ..... 156/DIG. 24 X |
| 5,953,887 | * | 9/1999 | Lucas et al. . |

FOREIGN PATENT DOCUMENTS 197 45 253 * 12/1998 (DE) .

5-229538 * 9/1993 (JP) .

* cited by examiner

*Primary Examiner*—Curtis Mayes
(74) *Attorney, Agent, or Firm*—TraskBritt

(57) ABSTRACT

An apparatus for consistently and accurately applying adhesive bar code labels to a target surface on the edge of trays such as JEDEC trays. The bar code applicator includes a base having a label seat for supporting a bar code label that is to be applied to a JEDEC tray. Slidably disposed within a carriage way on the base is a carriage for holding a JEDEC tray. The carriage has a plurality of structural features that allows for the accurate and repetitive longitudinal and lateral alignment of a JEDEC tray within the carriage. The carriage also has a target window. The label seat extends up from the carriage way and into the target window of the carriage, thereby enabling a label resting on the label seat to make contact with the target surface of a JEDEC tray supported within the carriage when the carriage is moved downward with respect to the base. To prevent adhesion of the bar code label to a target surface prior to the proper alignment of the JEDEC tray within the carriage, a plurality of biasing elements and a plurality of retaining elements are disposed between the carriage and base and function to maintain the target surface of a JEDEC tray at a vertical separation distance from the adhesively backed bar code label. Application of the label is effected by pressing downwardly on the JEDEC tray to compress the biasing elements and place the label in the label seat in contact with a lateral edge of the tray.

28 Claims, 5 Drawing Sheets

APPARATUS AND METHOD FOR LABEL APPLICATION TO TRAYS FOR RECEIVING SEMICONDUCTOR CHIPS

BACKGROUND OF THE INVENTION

1. Field of the Invention

The present invention relates generally to the inventory control and identification of semiconductor chips during manufacturing and testing. Specifically, the present invention relates to an apparatus and method for the consistent and accurate placement of adhesive bar code labels on semiconductor chip processing trays.

2. State of the Art

During manufacturing and testing of semiconductor chips, processing trays are routinely used for handling large numbers of chips. Processing trays designed and built in compliance with standards propagated by the Joint Electronic Device Engineering Council (JEDEC)—commonly referred to as JEDEC trays—are widely used within the semiconductor industry. Generally, JEDEC trays consist of a grid-like, open lattice structure defining a plurality of cavities in rows and columns capable of holding a plurality of semiconductor chips in a two-dimensional array. The trays, which are usually injection molded from plastic, vary in overall dimensions and grid size, depending on the type of chip the tray is designed to hold. JEDEC trays also have surface features, such as locating and hold-down tabs, that allow the trays to be manipulated by automated handling equipment. Additionally, JEDEC trays are stackable, allowing for the simultaneous handling or storage of large numbers of semiconductor chips.

To facilitate inventory tracking and control, test lot identification, sorting and binning, and subsequent storage and shipping of semiconductor chips, manufacturers typically place some type of identification tag on each JEDEC tray. A commonly used identification tag used with JEDEC trays is an adhesive bar code label. The bar code label is typically applied to a lateral edge of the JEDEC tray, and the label allows the manufacturer or customer to identify the contents of each tray in an automated processing system by scanning the label with a bar code reader.

Numerous devices for applying adhesive labels, and similar devices for applying ink stamps, exist in the prior art. Sato et al., U.S. Pat. No. 4,436,573; Pfeffer, U.S. Pat. No. 4,369,582; and Kerr, Jr., U.S. Pat. No. 5,851,332, all disclose devices directed to the manual application of adhesive labels. Dour et al., U.S. Pat. No. 5,517,916, discloses a self-inking stamp for manually applying an ink stamp. Also, Matsuguchi, U.S. Pat. No. 4,585,505, and Franklin et al., U.S. Pat. No. 5,540,795, disclose label applying systems adaptable to automation.

Application of a bar code label to a JEDEC tray is usually accomplished by manual, hand-placement of the label to the JEDEC tray edge. However, hand-placement of a bar code label to a JEDEC tray has proven to be insufficiently accurate for use with automated manufacturing equipment. To identify the contents of a JEDEC tray, automated processing systems generally rely on the bar code reader to scan the bar code associated with each tray. The task of scanning a bar code label within an automated production line requires that the bar code be accurately and repeatably located relative to the reader. This task is frustrated by the manual application of adhesively backed bar code labels, which may result in the inconsistent and inaccurate placement of some labels upon a corresponding application surface. Thus, a need exists in the semiconductor industry for an apparatus and method directed to the application of an adhesive bar code label to a JEDEC tray that is accurate and, at the same time, repeatable.

SUMMARY OF THE INVENTION

The present invention comprises an apparatus and method for the consistent and accurate placement of a bar code label upon the application, or target, surface of a tray for semiconductor chips, such as a JEDEC tray. It is a further object of the present invention that the apparatus for applying the bar code label be simple to use and easily adaptable to various sizes of trays. It should be noted that, although the present invention is particularly suitable for the application of bar code labels to JEDEC trays, the apparatus and method of the present invention are applicable to the placement of any type of adhesive identification tag to all kinds of structures, such as trays or boxes used for handling consumer goods, during production.

The bar code applicator of the present invention is generally comprised of a carriage, which holds a JEDEC tray for application of a bar code label, and a base to support both the carriage and a label seat. Resting upon the top surface of the label seat, adhesive side up, is a bar code label that is to be applied to the JEDEC tray. To support the carriage, the base may include a carriage way in which the carriage is slidably disposed. The label seat extends upwards from the base within the carriage way. To provide for the accurate and repeatable placement of a JEDEC tray within the carriage, the carriage is fitted with a series of edge guides as well as an edge plane and a register surface. The edge plane and register surface are perpendicular to one another and each engages an edge of the JEDEC tray in an abutting relationship to effect longitudinal and lateral alignment thereof and to vertically align the JEDEC tray so that a lateral edge thereof is substantially parallel to a top surface of the label seat. Also, the carriage has a window therein of a size and shape through which the label seat may pass, allowing the label to bypass the carriage and adhere to a target surface on the edge of the JEDEC tray disposed on the carriage.

Biasing elements are disposed between the base and the carriage. In the uncompressed, or fully extended, position, the biasing elements bias the carriage away from the base such that the edge plane of the carriage is initially above the top surface of the label seat, thus obscuring the edge of a JEDEC tray resting upon the edge plane from a bar code label resting upon the top surface of the label seat. By applying a downward force to the carriage, the biasing elements are compressed and, when fully compressed, the carriage is bottomed-out within the carriage way, abutting the base. In the fully compressed condition of the biasing elements, the top surface of the label seat protrudes above the edge plane of the carriage, pressing the adhesive backing of the bar code label into contact with, so as to adhere to, the target surface on the JEDEC tray edge in a precise, repeatable manner.

Retaining elements may also be disposed between the base and carriage. The retaining elements, which may be rigidly affixed to the base and slidably interconnected with the carriage, limit the maximum vertical displacement of the carriage in the fully extended condition and also retard horizontal motion of the carriage relative to the base.

To operate the bar code applicator of the present invention, the user places an adhesive-backed bar code label upon the top surface of the label seat with the adhesive side facing upwards. The user then places a JEDEC tray upon the edge plane of the carriage, using the edge guides and register surface to consistently and accurately locate the tray laterally and longitudinally on the carriage. Application of the bar code label to the edge of the JEDEC tray is then accomplished by pushing downward on the JEDEC tray, and hence the carriage, until the biasing elements are fully compressed and the carriage is bottomed-out within the carriage way. In the fully compressed condition, the label seat extends above the edge plane of the carriage and so that the adhesive backing of the bar code label is adhered to the target surface of the JEDEC tray. The user then releases the JEDEC tray and associated carriage, allowing the biasing elements to fully vertically extend, and removes the tray, with affixed label, from the carriage.

The above-described method is then repeated with another JEDEC tray. By using the edge guides, edge plane, and register surface of the carriage, the user can repeatedly and accurately apply a bar code label to the target surface of subsequent JEDEC trays. The bar code applicator is easily adapted to different sizes of JEDEC trays. To adapt the applicator to a particular size of tray, a carriage with appropriately sized edge guides, edge plane, and register surface is disposed in the carriage way. Thus, the bar code applicator can be used with any size of JEDEC tray by associating a matching carriage with the applicator.

BRIEF DESCRIPTION OF THE SEVERAL VIEWS OF THE DRAWINGS

While the specification concludes with claims particularly pointing out and distinctly claiming that which is regarded as the present invention, the features and advantages of this invention can be more readily ascertained from the following detailed description of the invention when read in conjunction with the accompanying drawings, in which:

DETAILED DESCRIPTION OF THE INVENTION

Figure 1:
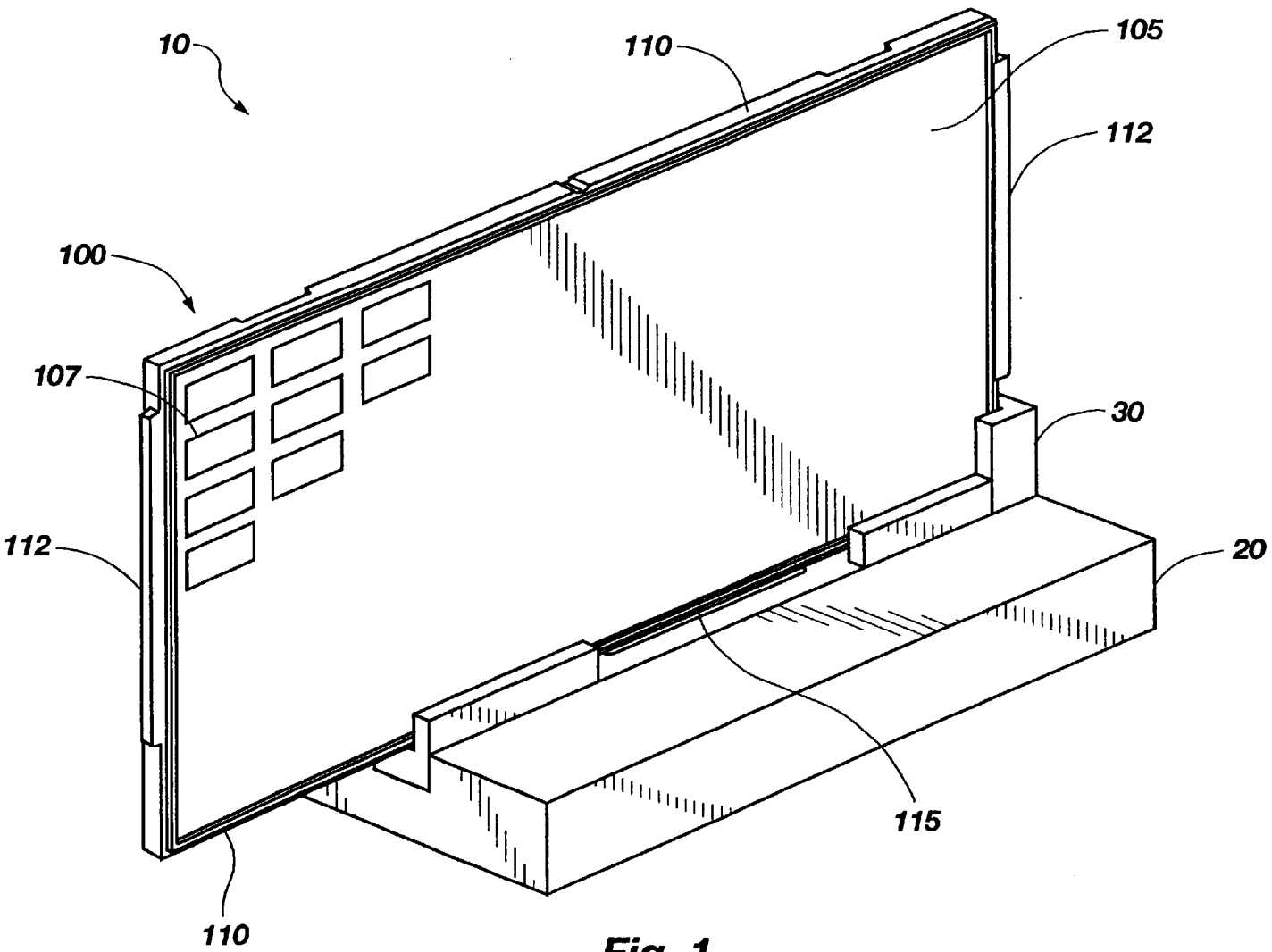
FIG. 1 is a perspective view of the bar code applicator of the present invention with a JEDEC tray.

FIG. 1 shows a bar code label applicator according to the present invention. The bar code label applicator 10 includes a base 20 and a carriage 30. Also shown in FIG. 1 is a JEDEC tray 100 removably positioned within the carriage 30. JEDEC tray 100 has a lattice region 105 forming a two-dimensional array of cavities 107 (only exemplary cavities 107 shown) for holding semiconductor chips, two pairs of mutually parallel, perpendicular lateral edges 110, 112 extending about the perimeter of the lattice region 105, and a target surface 115 on a lateral edge 110 upon which a bar code label (not shown) is to be applied.

Figure 2:
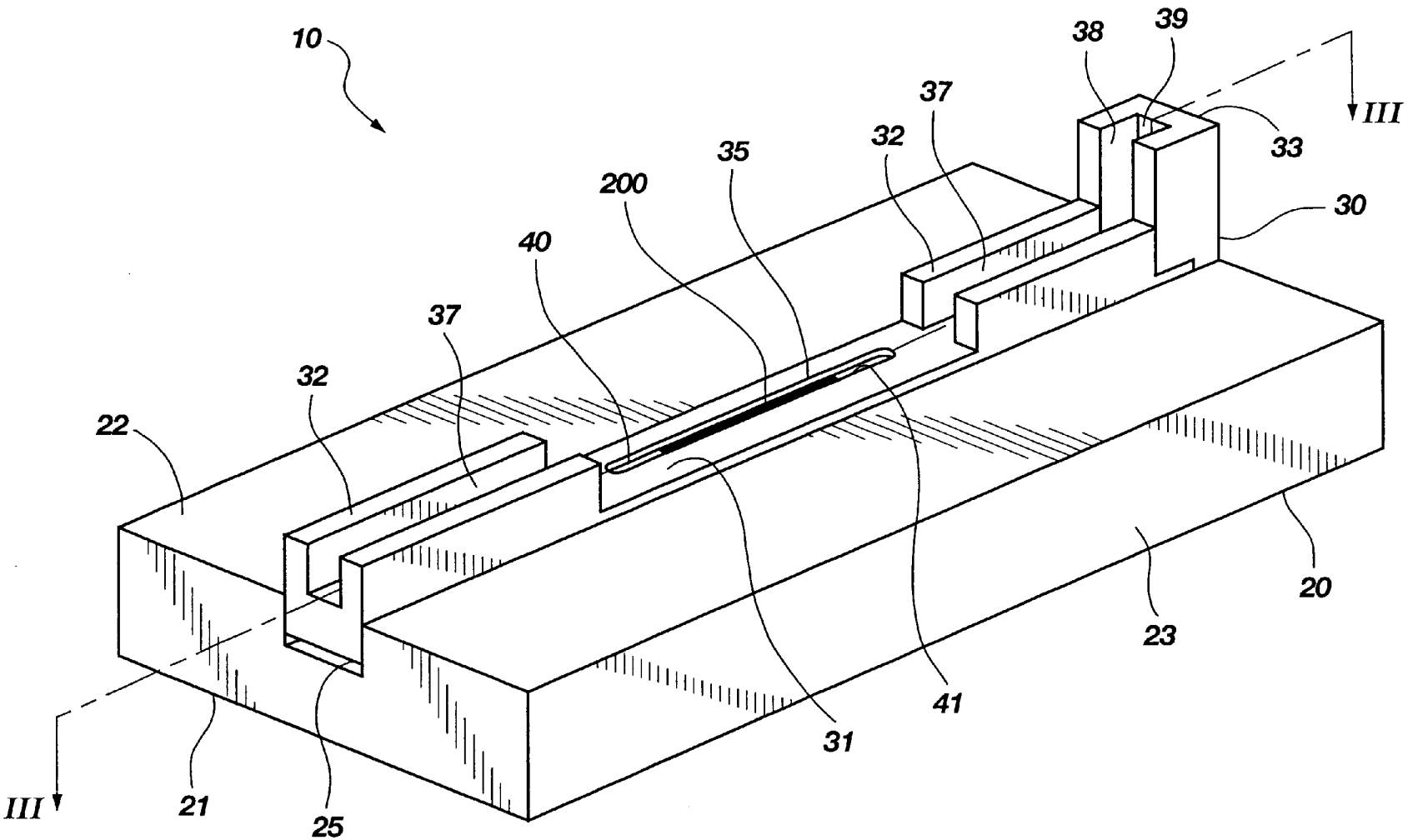
FIG. 2 is a perspective view of the bar code applicator in the fully extended position.

Referring to FIG. 2, in a preferred embodiment, the base 20 has a lower surface 21, an upper surface 22 parallel to the lower surface 21, and a lateral edge surface 23. Defined on the upper surface 22 of base 20 is a carriage way 25. Disposed within the carriage way 25 is the carriage 30. The shape and dimensions of both the carriage 30 and carriage way 25 are such that the carriage 30 mates with carriage way 25 in a sliding relationship. Extending up from the base 20 within the carriage way 25 is a label seat 40 having a top surface 41. The label seat 40 is rigidly attached to the base 20. A bar code label 200 that is to be applied to the target surface 115 of the JEDEC tray 100 is placed upon the top surface 41 of the label seat 40, with its adhesive backing facing away from the top surface 41. The adhesive backing preferably comprises a contact adhesive. The base 20, carriage 30, and label seat 40 may be fabricated from any suitable material as known in the art, including metals and molded plastics.

The carriage 30 has an edge plane 31, edge guides 32, and a tray stop 33. The edge plane 31 is substantially parallel with the top surface 41 of the label seat 40. The edge guides 32 and tray stop 33 define slots 37, 38, respectively. The width of the slots 37, 38 is such that the lateral edges 110, 112 of a JEDEC tray 100 can be snugly but slidably disposed within the slots 37, 38 for effecting lateral alignment thereof with bar code label 200. When received in carriage 30 within slots 37, 38, JEDEC tray 100 is oriented substantially perpendicular to base 20 and with a lateral edge 110 thereof substantially parallel to top surface 41 of label seat 40. The tray stop 33 also has a register surface 39 perpendicular to the edge plane 31 for effecting longitudinal alignment of JEDEC tray 100 with bar code label 200. Target window 35 extends vertically through carriage 30 to edge plane 31, and surrounds the label seat 40. The target window 35 is of such size and shape as to allow the carriage 30 to slidably move vertically relative to the label seat 40.

Figure 3:
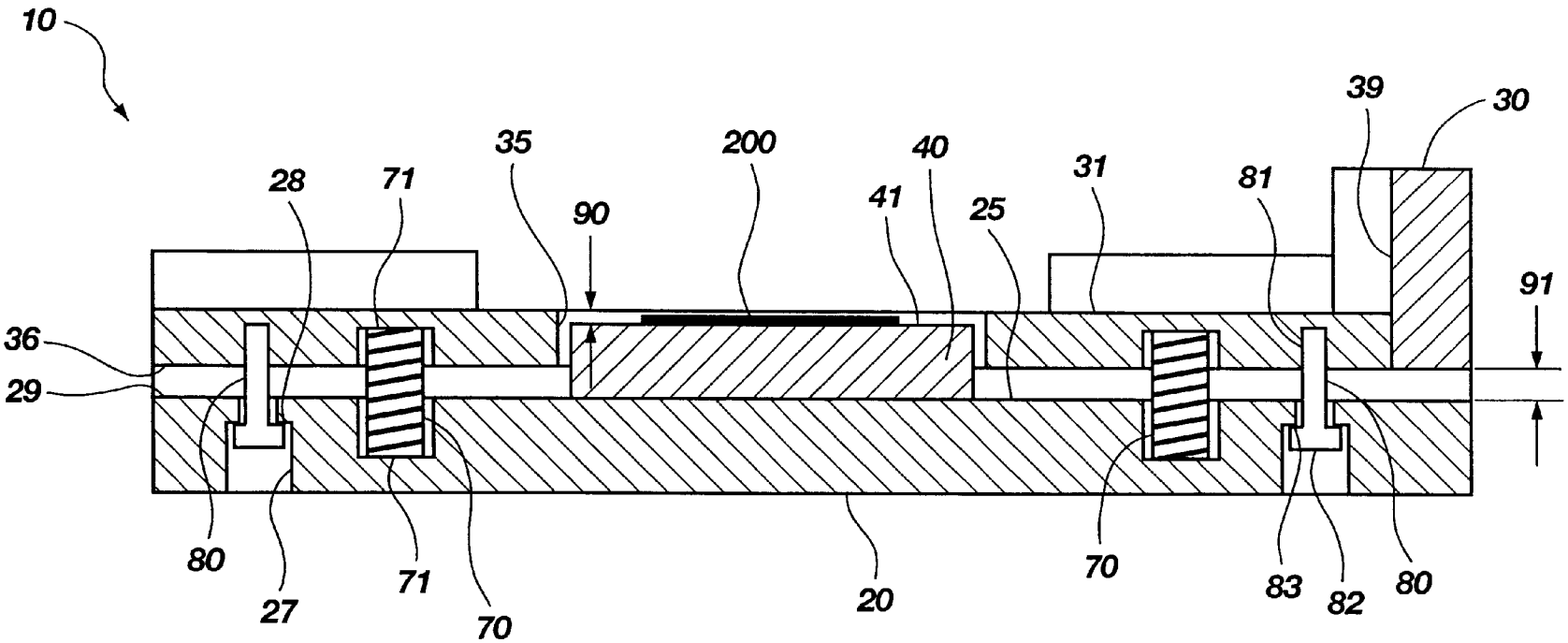
FIG. 3 is a cross-sectional view of the bar code applicator in the fully extended position taken along line III—III of FIG. 2.

FIG. 3 shows a cross-section of the bar code label applicator 10 taken along line III—III as shown in FIG. 2. Referring now to FIG. 3, extending between the base 20 and the carriage 30 is a plurality of biasing elements 70. The ends 71 of the biasing elements 70 may be rigidly attached to, or simply abut, the carriage 30 and base 20, respectively. The biasing elements 70, as shown in FIG. 3, are preferably coil springs made from spring-grade metals such as, for example, spring steel, stainless steel, spring brass, or beryllium-copper. However, the biasing elements 70 may be any structure capable of elastic deformation as known in the art, such as leaf springs, belleville springs, elastomeric blocks, etc. With the biasing elements 70 in a fully extended condition, the edge plane 31 of carriage 30 extends a distance 90 above the top surface 41 of label seat 40, and the lower surface 36 of carriage 30 extends a distance 91 above the bottom surface 29 of the carriage way 25. The separation distance 90 between the top surface 41 and the edge plane 31 prevents the adhesive backing of the bar code label 200 from contacting the target surface 115 of JEDEC tray 100 until the tray 100 is correctly positioned for label application.

Also disposed between the base 20 and carriage 30 is one or more of retaining elements 80. Each retaining element 80 has a first shank end 81 securely attached, as by threaded engagement, to the carriage 30 and a second opposing head end 82 that is slidably disposed with respect to the base 20 in bore 27. The second head end 82 has an annular retaining surface 83 that is aligned with a corresponding retaining surface 28 formed on the base 20. When the biasing elements 70 are in the fully extended position, the retaining surfaces 83 of retaining elements 80 abut the corresponding retaining surfaces 28 of base 20. This abutting, or interference, relationship between the retaining surfaces 83, 28 retains the carriage 30 within the carriage way 25 with the lower carriage surface 36 separated from the carriage way bottom surface 29 by a fixed distance (equal to distance 91).

The retaining elements 80 also retard planar motion (longitudinal motion parallel to the carriage way bottom surface 29) of the carriage 30 relative to the base 20.

Preferably, the retaining element or elements 80 are bolts wherein each head end 82 forms a retaining surface 83 and a threaded shank end 81 of each bolt is rigidly affixed to the carriage 30. Other structures known in the art, such as a rivet, may also function as the retaining elements 80. It will be appreciated by one of ordinary skill in the art that the orientation of the retaining element or elements 80 could be reversed such that the first shank ends 81 are rigidly attached to the base 20 and the second opposing head ends 82 are slidably connected to the carriage 30.

Figure 5:
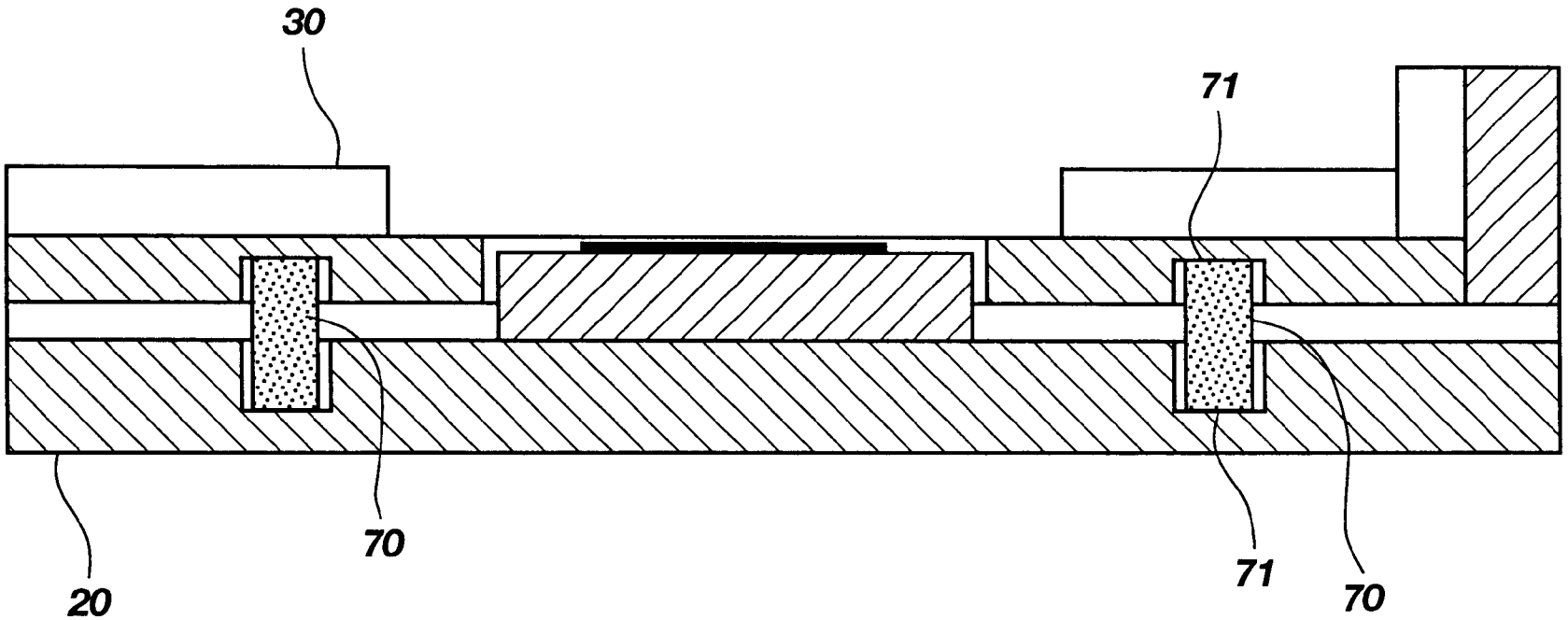
FIG. 5 is a cross-sectional view of the bar code applicator in the fully extended position taken along line III—III of FIG. 2.

In an alternative embodiment as shown in FIG. 5, the biasing elements 70 may be configured to simultaneously function as the retaining elements. Referring to FIG. 5, the retaining elements 70 as depicted therein comprise elastomeric blocks. The opposing ends 71 of the elastomeric retaining elements 70 are securely attached to the base 20 and carriage 30, respectively, by techniques known in the art such as adhesive or mechanical attachment. The retaining elements 70 will restrict both vertical (perpendicular to the base 20) and horizontal (parallel to the base 20) motion of the carriage 30. Those of ordinary skill in the art will appreciate that the retaining elements 70 of FIG. 5 may be of any suitable structure, and manufactured from any suitable material, as set forth above with respect to FIG. 3.

Referring to both FIGS. 1 and 2, a JEDEC tray 100 is located on the carriage 30 of the bar code label applicator 10 by placing the target surface 115 over the target window 35 and aligning the tray 100 within the slots 37, 38 of the edge guides 32 and tray stop 33, respectively. Proper and repeatable alignment of the tray 100 within the carriage 30, and relative to the label seat 40, is achieved by abutting an edge 110 of the tray 100 against the edge plane 31, and abutting a second, substantially perpendicular edge 112 of tray 100 against the register surface 39. When the edges 110, 112 are abutted against the edge plane 31 and register surface 39, respectively, the target surface 115 of the tray 100 is centered over the target window 35 and label seat 40, and the target surface 115 is further aligned with the bar code label 200 resting on the label seat 40.

With the JEDEC tray 100 properly located within the carriage 30 and the target surface 115 centered over the bar code label 200, the label 200 may be adhered to the target surface 115. Adhesion of the bar code label 200 to the target surface 115 is accomplished by pressing downwardly on the carriage 30 and thereby compressing the biasing elements 70. The carriage 30 may be depressed by simply pushing downwardly on the JEDEC tray 100. In the filly compressed condition, the biasing elements 70 are compressed a distance 91 (see FIG. 3), at which point the lower surface 36 of the carriage 30 rests against the bottom surface 29 of the carriage way 25. Also, the retaining surfaces 83, 28 of the retaining elements 80 and base 20, respectively, do not contact one another in the fully compressed condition.

Figure 4:
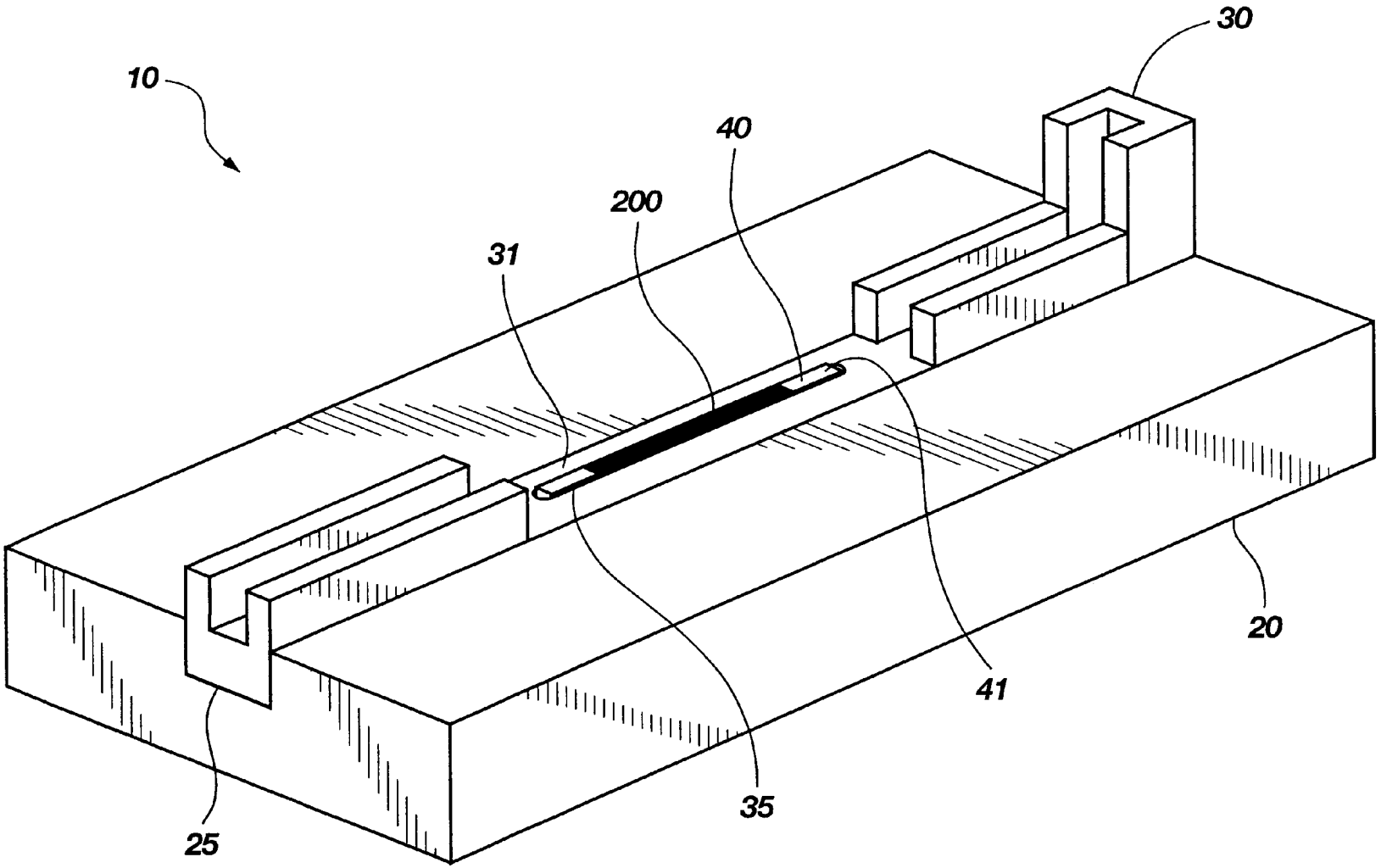
FIG. 4 is a perspective view of the bar code applicator in the fully compressed position.

When the carriage 30 is filly depressed within the carriage way 25, the top surface 41 of the label seat 40 extends a distance (equal to the difference between the distance 91 and the distance 90) above the edge plane 31 of the carriage 30 sufficient to allow the top surface 41 to make contact with the target surface 115. FIG. 4 shows the bar code label applicator 10 in the fully compressed condition (tray 100 not shown). The carriage 30 is fully depressed within the carriage way 25, and the top surface 41 of the label seat 40 extends through the target window 35 and above the edge plane 31 of the carriage 30. Thus, in the fully compressed condition, the adhesive backing of the label 200 will make firm and substantially uniform contact with the target surface 115 of the JEDEC tray 100, adhering the bar code label 200 to the target surface 115.

To release the JEDEC tray 100 with attached label 200, the downward force is simply released from the JEDEC tray 100. With no downward force applied to the carriage 30, the biasing elements 70 will return to the fully extended condition and the lower surface 36 of carriage 30 is again separated from the bottom surface 29 of carriage way 25 by a distance 91. The process of placing a bar code label 200 on top surface 41 of label seat 40, inserting a JEDEC tray 100 into the carriage 30 and depressing the carriage 30 to adhere the label 200 to the target surface 115 is then repeated. The carriage alignment features (edge plane 31, register surface 39, and slots 37, 38 defined by the edge guides 32 and tray stop 33, respectively) allow for the consistent and accurate longitudinal and lateral placement of the target surface 115 relative to a label 200 resting upon the label seat 40. Thus, bar code labels are accurately and repeatedly applied to the same location of each JEDEC tray of a plurality of identical JEDEC trays. The bar code applicator 10 can be adapted to various sizes of JEDEC trays 100 by varying the orientation and dimensions of the carriage alignment features.

The foregoing detailed description and accompanying drawings are only illustrative and not restrictive. They have been provided primarily for clearness of understanding and no unnecessary limitations are to be understood therefrom. Numerous modifications and alternative arrangements may be devised by those skilled in the art without departing from the spirit of the present invention and the scope of the appended claims.

What is claimed is:

1. A device for applying an adhesive-backed label to a substantially rectangular substrate having a first substrate edge, a second substrate edge perpendicular to said first substrate edge, and a target surface on said first substrate edge, comprising:

a base having an upper portion with a carriage way defined therein;

a label seat having a top surface for supporting said adhesive-backed label, said label seat located within said carriage way on said base;

a carriage slidably disposed within said carriage way and having an edge plane parallel to the top surface of said label seat, a register surface perpendicular to said edge plane, and a target window therethrough aligned with said label seat; and at least one biasing element interposed between said carriage and said base.

2. The device of claim 1, further comprising:

at least one base retaining surface on said base; and at least one retaining element for limiting displacement of said carriage within said carriage way, said at least one retaining element affixed to said carriage and slidably connected to said base, and having a retaining surface place to provide for an abutting relationship with said at least one base retaining surface under biasing from said at least one biasing element.

3. The device of claim 2, wherein the at least one retaining element is comprised of the at least one biasing element.

4. The device of claim 3, wherein the at least one biasing element is securely attached to said carriage and securely attached to said base.

5. The device of claim 1, further comprising at least one edge guide configured to receive at least said first substrate edge, said at least one edge guide extending upwardly from said edge plane of said carriage.

6. A label applicator for applying an adhesive-backed label to a tray, comprising:

a base;

a label seat affixed to said base;

a carriage vertically movably disposed on said base and configured to receive said tray; and at least one biasing element disposed between said carriage and said base.

7. The label applicator according to claim 6, further including at least one retaining element disposed between said carriage and said base and configured for limiting travel of said carriage with respect to said base.

8. The label applicator according to claim 7, wherein said at least one retaining element is comprised of said at least one biasing element.

9. The label applicator according to claim 6, wherein said carriage further includes at least one surface configured to limit lateral movement of said tray with respect to said carriage.

10. The label applicator according to claim 6, wherein said carriage further includes at least one surface configured to limit longitudinal movement of said tray with respect to said carriage.

11. The label applicator according to claim 6, wherein said base further includes at least one surface configured to limit lateral movement of said carriage with respect to said base.

12. The label applicator according to claim 6, wherein said base further includes at least one surface configured to limit longitudinal movement of said carriage with respect to said base.

13. A method of applying a label having an adhesive backing to a tray, comprising:

biasing said tray away from said adhesive backing of said label;

aligning a target surface of said tray with respect to said adhesive backing of said label; and forcing said tray against said adhesive backing of said label to adhere said label to said target surface of said tray.

14. The method of claim 13, wherein said biasing said tray away from said adhesive backing comprises:

providing a base configured to support said label and configured to slidably support a carriage, said carriage being configured to removably receive said tray;

placing said tray in said carriage; and interposing at least one biasing element between said base and said carriage to bias said carriage away from said base.

15. The method of claim 14, wherein said aligning a target surface of said tray with respect to said adhesive backing comprises:

providing a target window through said carriage aligned with said label supported by said base;

providing a substantially planar surface on said carriage substantially parallel to said label supported by said base; and abutting said target surface of said tray against said substantially planar surface and above said target window.

16. The method of claim 15, further including:

providing at least one surface on said carriage configured to limit lateral movement of said tray with respect to said carriage; and abutting said tray against said at least one surface configured to limit lateral movement.

17. The method of claim 15, further including:

providing at least one surface on said carriage configured to limit longitudinal movement of said tray with respect to said carriage; and abutting said tray against said at least one surface configured to limit longitudinal movement.

18. The method of claim 14, wherein said forcing said tray against said adhesive backing comprises:

applying a force to said tray sufficient to overcome said at least one biasing element; and moving said carriage towards said base until said target surface of said tray contacts said adhesive backing of said label.

19. The method of claim 18, further comprising limiting movement of said carriage with respect to said base with at least one retaining element, said at least one retaining element being securely attached to one of said base and said carriage and configured to slidably move with respect to one other of said base and said carriage.

20. The method of claim 14, further comprising supporting said label on said base in a label seat secured to said base and configured to support said label in a substantially parallel relationship with said target surface of said tray.

21. A method of applying an adhesive-backed label to a tray, comprising:

providing a base;

providing a label seat attached to said base;

providing a carriage slidably disposed on said base and configured to receive said tray;

disposing at least one biasing element between said carriage and said base to bias said carriage away from said label seat;

placing said adhesive-backed label on said label seat;

disposing said tray on said carriage; and compressing said at least one biasing element until said adhesive-backed label contacts said tray and adheres thereto.

22. The method according to claim 21, wherein providing a carriage slidably disposed on said base further includes providing at least one retaining element disposed between said carriage and said base to limit travel of said carriage with respect to said base.

23. The method according to claim 22, wherein said providing at least one retaining element comprises providing at least one biasing element configured to bias said carriage away from said label seat and configured to limit travel of said carriage with respect to said base.

24. The method according to claim 21, wherein said disposing said tray on said carriage comprises:

providing at least one surface on said carriage configured to limit lateral movement of said tray with respect to said carriage; and abutting said tray against said at least one surface configured to limit lateral movement.

25. The method according to claim 21, wherein said disposing said tray on said carriage comprises:

providing at least one surface on said carriage configured to limit longitudinal movement of said tray with respect to said carriage; and abutting said tray against said at least one surface configured to limit longitudinal movement.

26. The method according to claim 21, wherein said providing a carriage slidably disposed on said base comprises:

providing at least one surface on said base configured to limit lateral movement of said carriage with respect to said base; and slidably abutting said carriage against said at least one surface configured to limit lateral movement.

27. The method according to claim 21, wherein said providing a carriage slidably disposed on said base comprises:

providing at least one surface on said base configured to limit longitudinal movement of said carriage with respect to said base; and slidably abutting said carriage against said at least one surface configured to limit longitudinal movement.

28. The method according to claim 21, wherein said disposing said tray on said carriage comprises:

providing a substantially planar surface on said carriage substantially parallel to said adhesive-backed label on said label seat; and abutting said tray against said substantially planar surface.

* * * * *